United States Patent [19]

Leighton

[11] Patent Number: 4,541,184

[45] Date of Patent: Sep. 17, 1985

[54] INSOLE

[75] Inventor: Kenneth B. Leighton, Solon, Ohio

[73] Assignee: Spectrum Sports, Inc., Twinsburg, Ohio

[21] Appl. No.: 541,589

[22] Filed: Oct. 13, 1983

[51] Int. Cl.[4] ..... A43B 13/38; A43B 13/40

[52] U.S. Cl. ..... 36/44; 36/91; 128/615; 128/621; 128/622

[58] Field of Search ..... 36/43, 44, 91; 128/615, 128/619, 621, 622, 595, 587

[56] References Cited

U.S. PATENT DOCUMENTS

| | | | |
|---|---|---|---|
| 1,158,693 | 11/1915 | Landolt | 36/44 |
| 1,387,691 | 8/1921 | Davenport | 36/44 |
| 1,676,355 | 7/1928 | Saperston | 128/587 |
| 1,702,531 | 2/1929 | Ambill | 128/587 |
| 1,804,009 | 5/1931 | Gregarek | 36/43 |
| 1,808,461 | 6/1931 | Gregarek | 36/43 |
| 2,631,387 | 3/1953 | Shaw | 36/43 |
| 3,457,659 | 7/1969 | Coleman | 36/44 |
| 3,594,929 | 7/1971 | Stohr | 36/44 |
| 3,730,169 | 5/1973 | Fiber | 36/44 |
| 4,232,457 | 11/1980 | Mosher | 36/91 |
| 4,316,335 | 2/1982 | Giese et al. | 36/129 |
| 4,364,188 | 12/1982 | Turner et al. | 36/31 |
| 4,378,642 | 4/1982 | Light et al. | 36/35 R |

FOREIGN PATENT DOCUMENTS

| | | | |
|---|---|---|---|
| 588504 | 12/1959 | Canada | 36/43 |
| 2806481 | 8/1979 | Fed. Rep. of Germany . | |
| 1564195 | 4/1980 | United Kingdom | 36/43 |

*Primary Examiner*—Werner H. Schroeder
*Assistant Examiner*—Steven N. Meyers
*Attorney, Agent, or Firm*—Maky, Renner, Otto & Boisselle

[57] ABSTRACT

An insole includes an abrasion-resistant fabric top covering adhered to a layer of molded modified dense polyurethane contoured to provide maximum shock absorption under those areas of the foot most subject to impact loading and a minimum thickness of polyurethane under the remaining portions of the foot. In addition, a series of grooves extending primarily parallel to the axis of the foot are formed in the lowermost surface of the shock absorbing polyurethane. These grooves provide volume into which the polyurethane may deform during impact, thereby enhancing the shock absorbing qualities of the material.

17 Claims, 6 Drawing Figures

INSOLE

FIELD OF THE INVENTION

The present invention relates to insoles.

BACKGROUND OF THE INVENTION

In the past insoles have been made of various materials in an attempt to protect the foot, ankle, knee and various other body structures from the impact associated with walking, running or athletic competition. Among the materials which have been used in the past to fabricate such insoles is the novel elastomer disclosed in U.S. Pat. No. 4,346,205, which is incorporated herein by reference. The material disclosed therein, sold under the trademark SORBOTHANE, is a flexible non-cellular polyurethane of essentially linear structure containing unsatisfied hydroxyl groups, having a compression set less than 15% and preferably less than 5%. At break the material has an elongation of at least 500% and a recovery which is delayed after compression by at least 0.7 seconds. The elastomer disclosed in said patent has a hardness on the Shore 00 scale not exceeding 50, preferably not exceeding 20, and most preferably in the range of 0 to 10. Said patent further suggests that the disclosed elastomeric material may find application in sportswear including athletic shoes, and shock absorber inserts, among others.

Some prior art insoles have been made of essentially homogeneous material of uniform thickness. Others have been made with fabric over an underlying shock absorbing layer. In still others, the underlying shock absorbing layer has been formed with various recesses in the lower surface thereof.

SUMMARY OF THE INVENTION

The present invention provides a new and improved insole formed of a material similar to that shown in U.S. Pat. No. 4,356,205. The insole of the present invention includes an abrasion-resistant fabric top covering adhered to a layer of molded modified, dense polyurethane contoured to provide maximum shock absorption under those areas of the foot most subject to impact loading and a minimum thickness under the remaining portions of the foot. In addition, a series of grooves extending generally parallel to the axis of the foot are formed in the lowermost surface of the shock absorbing material. These grooves provide volume into which the material may deform during impact, thereby enhancing the shock absorbing qualities of the material.

The invention, then, comprises the features hereinafter fully described and particularly pointed out in the claims, the following description and annexed drawings setting forth in detail an illustrative embodiment of the invention, this being indicative, however, of but one of the various ways in which the principles of the present invention may be carried out.

DETAILED DESCRIPTION OF THE DRAWINGS

DESCRIPTION OF PREFERRED EMBODIMENT

Figures 1, 2, 3:
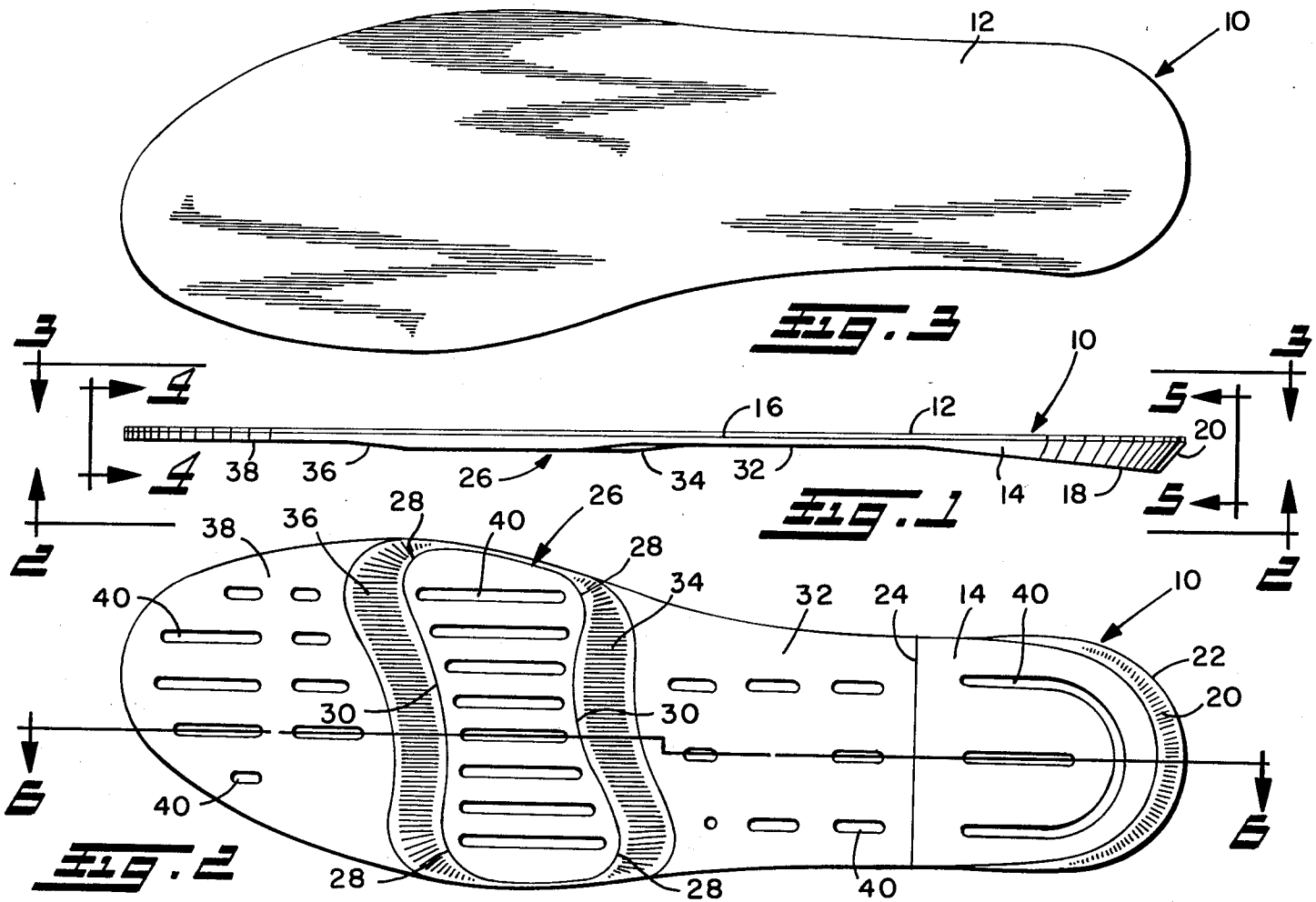
FIG. 1 shows a side elevation view of an insole constructed in accordance with the present invention.
FIG. 2 is a view looking in the direction of arrows 2—2 of FIG. 1.
FIG. 3 is a view looking in the direction of arrows 3—3 of FIG. 1.
Figure 5:
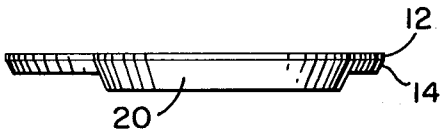
FIG. 5 is a view looking in the direction of arrows 5—5 of FIG. 1.
Figure 4:
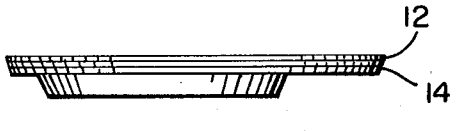
FIG. 4 is a view looking in the direction of arrows 4—4 of FIG. 1.

The insole 10 (FIG. 1) constructed in accordance with the present invention includes an abrasion-resistant fabric layer 12 adhered to a molded polyurethane layer 14. As shown in FIGS. 2 and 3, the fabric 12 and polyurethane 14 have a peripheral contour which approximates that of the human foot, and the insole 10 is intended to be worn inside a shoe.

The polyurethane 14 is generally similar to the flexible, non-cellular polyurethane described and claimed in U.S. Pat. No. 4,346,205 which is incorporated herein by reference. This material is a modified dense polyurethane of essentially linear structure containing unsatisfied hydroxyl groups and having a compression set of less than 15% and preferably less than 5%. This polyurethane has an elongation at break of at least 500%, and a recovery which is delayed after compression by at least 0.7 seconds.

In contrast to the polyurethane disclosed in said patent which has a hardness on the Shore 00 scale of most preferably between 0 and 10, the polyurethane 14 of which the lower portion of the insole 10 is formed has a hardness on the Shore 00 scale of between 20 and 70.

The polyurethane 14 is molded with a flat top surface 16 to which the fabric layer 12 is adhesively bonded.

The polyurethane 14 is formed in a mold with the fabric layer 12 in the bottom of the mold. In this way, the fabric and polyurethane are intimately and permanently bonded to each other.

The lowermost surface of the polyurethane 14 is contoured to be thickest under the heel and metatarsal portions of the foot. In these regions impact during foot strike may be as large as 17 G's. The polyurethane 14 includes an integrally formed heel pad 18 taking the form of a wedge-shaped region beneath the heel. The heel pad 18 tapers from a maximum thickness of about 0.32 inch at the rearmost portion of the heel to a thickness of about 0.08 inch in an axial distance of about 2½ inches. The heel pad 18 is surrounded by a beveled inclined surface 20 which tapers upwardly and outwardly when the insole 10 is in use and lies at approximately a 45° angle to the plane of the fabric layer 12. The beveled surface 20 follows the curved perimeter 22 of the heel portion of the insole 10.

From the front edge 24 of the heel pad 18 the insole 10 has a uniform thickness of approximately 0.08 inch until it reaches the region under the ball of the foot, the metatarsal region. In this region, again, the polyurethane is thickened but in this case it increases to a thickness of about 0.14 inch. This thickened region forms a metatarsal pad 26 which is integrally formed from the polyurethane 14.

The metatarsal pad 26 is essentially an oblong region extending transversely to the axis of the foot. The metatarsal pad 26 has curved corners 28 and inwardly or concavely curved sides 30. The transition from the relatively thin area 32 between the wedge-shaped heel pad 18 and the metatarsal pad 26 is achieved by a gentle sloping region 34 which forms approximately a 5° angle with the plane of the fabric layer 12. A similar sloping region 36 connects the front or leading side of the metatarsal pad 26 with a thin region 38 underlying the toes. The thin portion 38 is the same thickness as the intermediate thin portion, approximately 0.08 inch.

Figure 6:
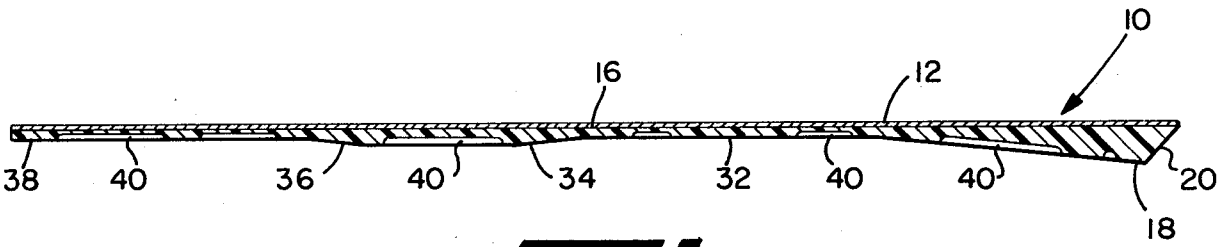
FIG. 6 is a view looking in the direction of arrows 6—6 of FIG. 2.

The insole 10 also includes a plurality of grooves 40 arranged as shown formed in the lowermost surface of the polyurethane. The grooves 40 are all of the same semicircular cross section (FIG. 6), typically having a radius of about 0.062 inch. The grooves provide space into which the polyurethane 14 may deform during impact, and therefore provide added shock absorbing capabilities not possible in the absence of the grooves.

The insole 10 protects the musculoskeletal system from excessive shock and twisting forces. Not only does the polyurethane 14 absorb the impact forces of an ordinary footfall, but also the material absorbs the shear forces which obtain during twisting. Thus the material 14 can absorb applied forces in a vertical direction, in a horizontal direction, and in any combination thereof. The added thickness in the form of a heel pad and metatarsal pad in regions of greatest impact provides superior protection to all body structures involved.

What is claimed is:

1. An insole comprising an uppermost layer of abrasion-resistant material and a lower layer of shock absorbing compressible elastomeric material, said lower layer including a wedge-shaped pad under the heel, a thickened pad under the metatarsal region, a portion of uniform thickness between said wedge-shaped heel pad and said metatarsal pad and a region of uniform thickness from the metatarsal region forward.

2. The insole of claim 1 wherein said shock absorbing material is a modified dense polyurethane which is flexible and non-cellular, has an essentially linear structure containing unsatisfied hydroxyl groups, has a compression set of less than 15%, an elongation at break of at least 500% and a recovery which is delayed after compression by at least 0.7 seconds.

3. The insole of claim 2 wherein said wedge-shaped heel pad is bounded by an inclined surface.

4. The insole of claim 2 wherein said metatarsal pad is bounded by an inclined region.

5. The insole of claim 2 further including a plurality of recesses formed in the lower surface thereof.

6. The insole of claim 5 wherein said recesses have a semicircular cross section.

7. The insole of claim 5 wherein said recesses are elongated.

8. The insole of claim 5 wherein said recesses are elongated in a direction generally parallel to the axis of the foot.

9. The insole of claim 5 wherein said wedge-shaped pad and thickened pad each have formed therein a plurality of said recesses.

10. An insole comprising an uppermost layer of abrasion-resistant material and a lower layer of shock absorbing compressible elastomeric material, said lower layer having integral thickened pads respectively under the heel and the metatarsal region, and a relatively smaller uniform thickness under the remainder of the foot.

11. The insole of claim 10 wherein said shock abosorbing material is a modified dense polyurethane which is flexible and non-cellular, has an essentially linear structure containing unsatisfied hydroxyl groups, has a compression set of less than 15%, an elongation at break of at least 500% and a recovery which is delayed after compression by at least 0.7 seconds.

12. The insole of claim 10 further including a plurality of recesses formed in the lower surface thereof.

13. The insole of claim 12 wherein said recesses have a semi-circular cross section.

14. The insole of claim 12 wherein said recesses are elongated.

15. The insole of claim 12 wherein said recesses are elongated in a direction generally parallel to the axis of the foot.

16. The insole of claim 12 wherein said thickened pads each have formed therein a plurality of said recesses.

17. The insole of claim 10 wherein said thickened pads are each bounded by a respective inclined surface.

* * * * *